United States Patent [19]

Nemoto et al.

[11] 4,075,418

[45] Feb. 21, 1978

[54] STEREOPHONIC PICKUP CARTRIDGE

[75] Inventors: Mitsuo Nemoto, Machida; Kimiyasu Honma, Kokubunji, both of Japan

[73] Assignee: Kabushiki Kaisha Audio-Technica, Machida, Japan

[21] Appl. No.: 580,159

[22] Filed: May 23, 1975

Related U.S. Application Data

[60] Continuation-in-part of Ser. No. 368,762, June 11, 1973, abandoned, which is a division of Ser. No. 849,767, Aug. 13, 1969, Pat. No. 3,761,647.

[30] Foreign Application Priority Data

Aug. 14, 1968 Japan ..... 43-57408
Feb. 3, 1969 Japan ..... 44-7290

[51] Int. Cl.[2] ..... H04R 11/12

[52] U.S. Cl. ..... 179/100.41 K; 179/100.41 M; 179/100.41 Z; 274/37

[58] Field of Search ..... 179/100.41 R, 100.41 M, 179/100.41 K, 100.41 S, 100.41 Z; 274/37

[56] References Cited

U.S. PATENT DOCUMENTS

| | | | |
|---|---|---|---|
| 3,184,555 | 5/1965 | Marshall | 179/100.41 K |
| 3,230,317 | 1/1966 | Freise | 179/100.41 K |
| 3,294,405 | 12/1966 | Pritchard | 179/100.41 K |
| 3,299,219 | 1/1967 | Madsen | 179/100.41 K |
| 3,576,955 | 5/1971 | Obata | 179/100.41 K |
| 3,679,843 | 7/1972 | Cho | 179/100.41 K |
| 3,720,796 | 3/1973 | Honma | 179/100.41 K |
| 3,761,647 | 9/1973 | Nemoto | 179/100.41 K |

FOREIGN PATENT DOCUMENTS

| | | | |
|---|---|---|---|
| 1,000,035 | 8/1965 | United Kingdom | 179/100.41 K |

*Primary Examiner*—Bernard Konick
*Assistant Examiner*—Alan Faber

[57] ABSTRACT

A stylus sub-assembly for incorporation in a stylus assembly itself destined for use in a cartridge mounted on a tone arm of a record player, the stylus assembly being constituted of an integral molded section composed of a mounting member, an armature securing member and a fulcrum wire interposed between the two members, and assembled to the molded section, an elongate cantilever arm having a stylus at an end thereof, and a pair of discrete armatures secured to the armature securing member and disposed on opposite sides of a vertical plane including the longitudinal axis of the cantilever arm.

13 Claims, 12 Drawing Figures

STEREOPHONIC PICKUP CARTRIDGE

Figure 1:
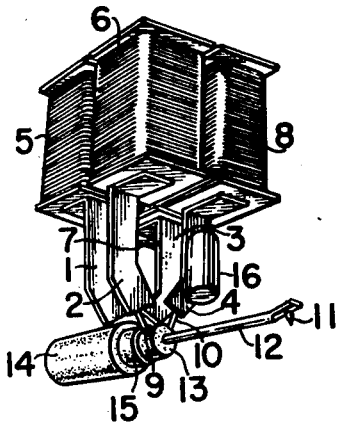

The present application is a continuation-in-part of our earlier application Ser. No. 368,762 filed June 11, 1973, now abandoned. The application Ser. No. 368,762 is a division of U.S. application Ser. No. 849,767 filed Aug. 13, 1969 and now U.S. Pat. No. 3,761,647 granted Sept. 25, 1973.

The invention relates to a stereophonic pickup cartridge of the electro-magnetic type for simultaneously reproducing two sound channels from a single groove record disc, and more particularly to such cartridge in which an armature (a) of permanent magnet material or (b) of high permeability magnetic material, in which case the armature is associated with a permanent magnet disposed adjacent the armature to magnetize the latter, is adapted to oscillate with the stylus tip, the vibration of said armature causing a change in the magnetic flux.

It is known that a vibrational system for pickup has a resonance point near the upper limit of reproduction where both the frequency response and the mechanical impedance present a peak. This results in disadvantages that the stylus is liable to hop when a high frequency signal recorded in a sound groove is to be reproduced or that a reproducible range of high frequencies is suppressed. Several techniques are proposed in the past for suppressing such a resonant peak, and a typical example is disclosed in U.S. Pat. No. 3,077,522 issued to Lee Gunter, Jr. et al on Feb. 12, 1963. The cited patent discloses a stylus assembly which is easily replaceable when the stylus tip is worn out. Specifically, a single magnet armature in the form of a tube or column is attached to a rear portion of a cantilever arm along its length, and is supported within an axial bore in a tubular bearing made of an elastic material and mounted in a sleeve.

One of the techniques for suppressing a resonant peak in the conventional pickups is to increase the damping resistance of the elastic material which supports the armature. However, it has been found that this results in an increased mechanical impedance in the mid-range frequencies, and therefore this technique is not extensively accepted. An alternative technique is what is incorporated in almost all of the present pickups, that is, reducing the equivalent mass of the vibrational system, i.e. the armature, cantilever arm and stylus tip. However, this involves drawbacks of a reduced sensitivity, liability to reproduce cross modulation distortion components in the high frequency range, and susceptibility to damage on account of its reduced structural rigidity. In these circumstances, it is apparent that any choice of constructing materials used or modification in the design can not completely eliminate a resonant peak in the conventional pickup.

It is also known to replace the permanent magnet of such a cartridge with an armature of high permeability material having a permanent magnet disposed adjacent the armature to magnetize the armature, thereby forming a cartridge of the induced magnet type. However, both types of cartridges are designed to provide channel separation from a change in magnetic flux in the common gap which results from the vibration of the permanent magnet or armature within the gap. This involves the inherent difficulty in providing an improved channel separation. In addition, because the stylus assembly must be supported by using elastic bearings between the permanent magnet or armature and its surrounding sleeve, there exists the drawback of producing cross modulation which is most deleterious to the tone quality. Furthermore, while the removal of the stylus assembly upon wear of the stylus is simple, when replacing, because of the compression applied to the sleeve when it is being inserted into the gap across pole pieces, the pre-adjusted orientation of the permanent magnet or armature which is supported by elastic bearings is liable to be disturbed.

Therefore, it is an object of the invention to provide an improved stereophonic pickup cartridge which is capable of completely avoiding the above disadvantages of the prior art cartridges.

It is a specific object of the invention to provide a pickup cartridge having a dual resonance vibrational system distinct from a conventional pickup and capable of suppressing the mechanical impedance in the high frequency range without increasing the mechanical impedance in the mid-range frequencies.

A further object of the invention is to provide a stereophonic pickup cartridge having improved channel separation which is substantially unaffected over the frequency spectrum thereby permitting improved stereophonic reproduction.

A further object of the invention is to provide a stereophonic cartridge with a stylus assembly which can be readily inserted into the cartridge body, maintained in proper orientation over a prolonged period and readily removed for replacement upon wear of the stylus tip.

A still further object of the invention is to provide a stylus sub-assembly constituted in part as an integral moulding comprising an armature securing member, a fulcrum wire and a mounting member for mounting the sub-assembly for form a stylus assembly for adaptation to a tone arm of a record-player.

A still further object of the invention is to provide a moulded structure susceptible for use as a stylus sub-assembly and which will materially reduce the cost and actual production of stylus sub-assemblies.

In accordance with the invention, there is provided a stylus assembly including a cantilever arm which carries a stylus tip at its forward end and to the rear end of which is secured a armature securing member of a material having a rigidity reduced as compared with that of the cantilever arm, with two armatures being positioned on the armature securing member. As a result of mounting the armatures on the cantilever arm through the interposition of the armature securing member having a reduced rigidity, rather than directly thereon, the equivalent circuit comprises a dual resonance vibrational system in which the stiffness of the armature securing member is present between the stylus tip and the armatures separately from an armature supporting bearing which is formed of an elastic material. A pickup cartridge having such a dual resonance vibrational system does not introduce difficulty in its manufacture, improves the frequency response in the high frequency range and achieves a desirable result in the reduction of the mechanical impedance, because the resonance frequency of the equivalent stiffness of an armature securing member can be designed to exist in a fairly high range.

Figure 2:
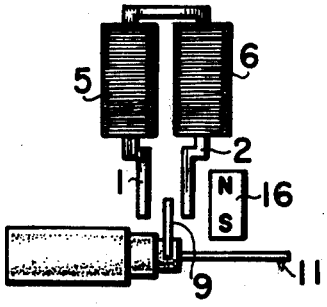
Figure 3:
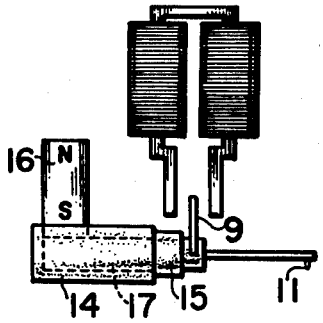

The above and other objects, features and advantages of the invention will become apparent from the following detailed description of embodiments thereof with reference to the drawings, in which:

FIG. 1 is a perspective view of the stereophonic pickup cartridge transducer according to one embodiment of the invention, FIG. 2 shows the embodiment of FIG. 1 in simplified elevation, FIG. 3 is an elevation of a similar embodiment as shown in FIG. 2 except that the permanent magnet is disposed rearwardly of the armature and a guide magnet is placed between the permanent magnet and the armature.

Figure 4:
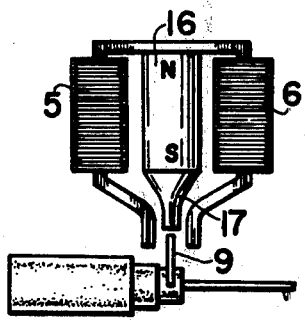
Figure 5:
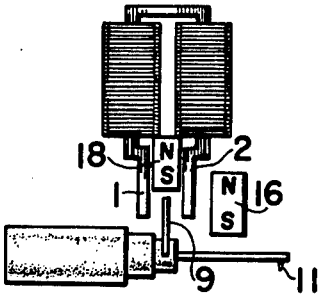
Figure 6:
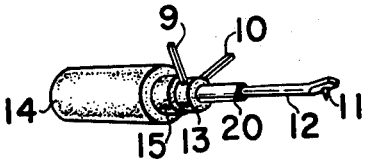
Figure 7:
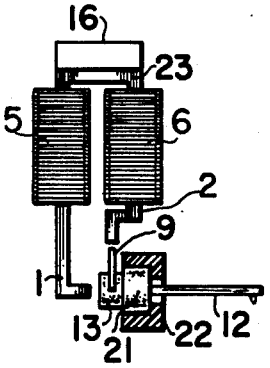
Figure 8:
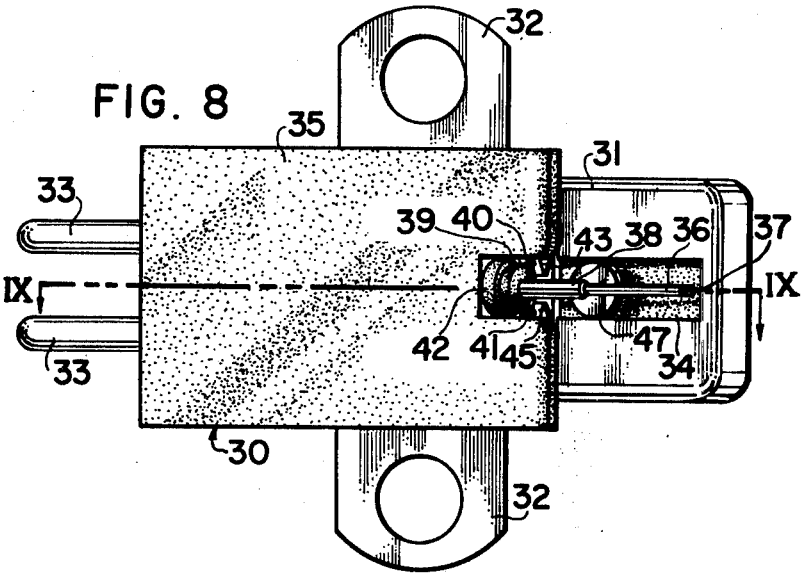
Figure 9:
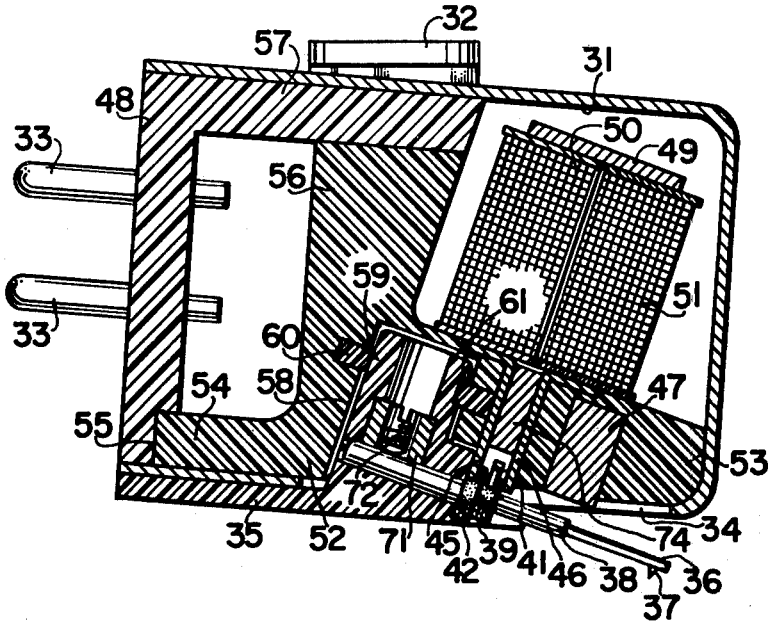
Figure 10:
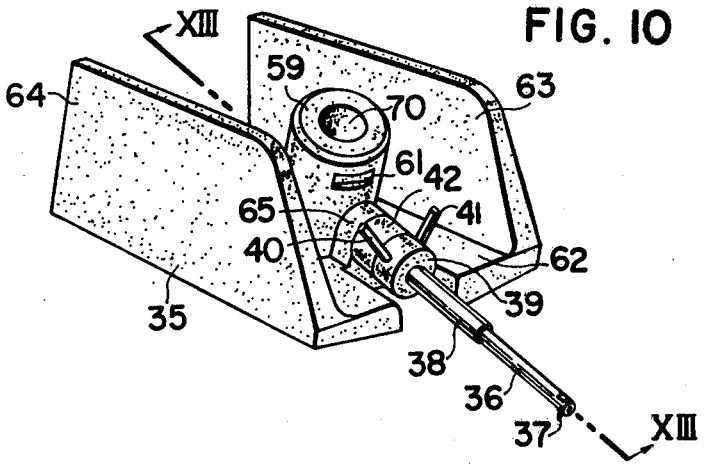
Figure 11:
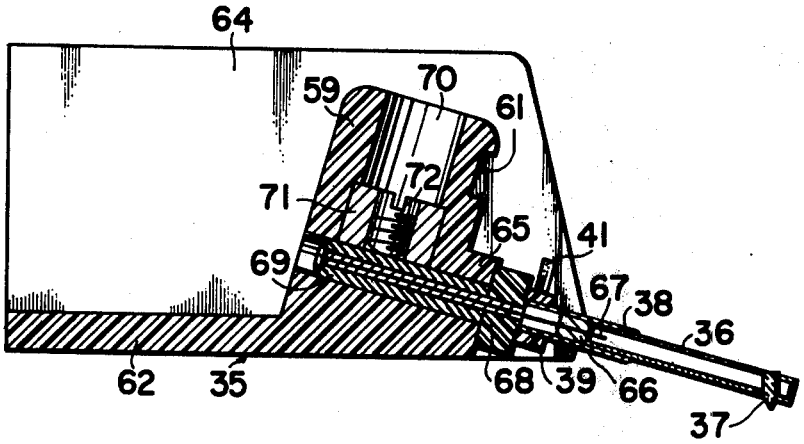
Figure 12:
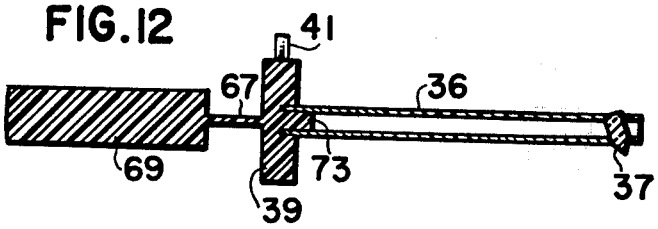

FIG. 4 shows, in elevation, a further modification of the transducer shown in FIG. 2 in which the permanent magnet is located inside the electromagnetic current generating means and is provide with a pole piece formed as an extension directed towards, the armature disposed between the pair of pole pieces of the electromagnetic means, FIG. 5 shows, in elevation, a still further modification of the transducer of FIG. 2 in which one additional permanent magnet is placed between the pole pieces of the electromagnetic means, FIG. 6 is a perspective view of a stylus assembly of the form generally similar to that of FIG. 1, but in which an auxiliary armature is fitted on the rear end of the cantilever, FIG. 7 is an elevation of another stereophonic pickup cartridge transducer of the invention incorporating an improved stylus assembly, FIG. 8 is a bottom view of the stereophonic pickup cartridge according to a further embodiment of the invention, FIG. 9 is a section along the line IX—IX in FIG. 8, FIG. 10 is a perspective view of the stylus assembly shown in FIGS. 8 and 9, FIG. 11 is a section, to an enlarged scale, along the line XIII—XIII in FIG. 10, and FIG. 12 is a similar view to FIG. 11 of a modified stylus sub-assembly.

FIG. 1 shows an electromagnetic current generating means including two pairs of pole pieces 1, 2 and 3, 4 and their associated coils 5, 6 and 7, 8. Each pair of pole pieces are parallel to each other and define an independent gap therebetween. The free ends of pole pieces are bent so that the pole pieces of one pair extend at right angles to the pole pieces of the other pair, and both pairs of pole pieces are positioned so that they include an angle of inclination of 45° with respect to the vertical plane. Coils 5 and 6 are connected in series as are coils 7 and 8. The two groups of coils are adapted to respond separately to a change in magnetic flux through the respective independent gaps to produce an electric current.

In the transducer according to this embodiment, a pair of armatures 9, 10 of high magnetic permeability material are positioned in the above mentioned independent gaps, respectively, in proper orientation. Thus in order to provide proper operation of the armatures in response to the vibration of a stylus tip 11, these armatures are arranged at the rear end of a cantilever 12 extending rearwardly from the stylus in a manner such that they extend perpendicularly with respect to the axis of the cantilever and extend at right angles to each other in corresponce to the independent gaps. Each armature is secured, not directly to the cantilever 12, but to an armature securing member 13 carried by the cantilever 12. In order for the armatures 9, 10 to be properly positioned in the respective independent gap, the vibration system including the armatures is carried by a holder 14. As will be further described in detail later, the holder 14 is a so-called cantilever holder in that a support or fulcrum wire (not shown in FIG. 1) secured to and extending axially rearwardly from the rear end of the cantilever 12 is connected to the holder 14 through the interposition of a damper 15 of an elastomeric material placed between the holder 14 and the armature securing member 13 so as to compress the damper 15 through a suitable tension in the wire, thereby holding the vibration system. In assembly, the vibration system assembly including the cantilever 12 and the holder 14 is suitably positioned with respect to the electromagnetic means so as to align the armatures within their associated gaps, and then the holder 14 is set in position. The damper 15 is formed from an elastomeric material, for example, synthetic rubber such as butyl rubber and allows for the oscillatory motion of the armatures 9, 10 in any direction and serves to return them to their neutral position. Similarly, the above mentioned support or fulcrum wire allows for such oscillatory motion of armatures 9, 10 and eliminates the risk that the armatures are displaced by a force transmitted from the stylus tip 11 and acting in the running direction of sound grooves.

In the illustrated embodiment, the transducer shown further includes a rod-shaped permanent magnet 16 which is placed adjacent the independent gaps in a vertical plane including the cantilever 12 for magnetizing the armatures 9 and 10. The permanent magnet 16 is magnetized in its axial direction and forms separate magnetic circuits, for right-and left-hand side channel, through armatures 9, 10 and pole pieces 1, 2 and 3, 4. Thus when armatures 9, 10 are subjected to vibration transmitted from the stylus tip 11, there is caused a change in magnetic flux in the gaps in which the armatures are placed, thereby inducing a voltage across coils 5, 6 and coils 7, 8 of the electromagnetic means which forms these gaps. In a double channel disc recorded according to the 45° - 45° system, each channel is cut at an angle of 45° with respect to the horizontal disc surface so that both channels are formed at right angles to each other. When the stylus tip is placed into a groove of the disc, a channel causes a movement of the stylus tip in a direction normal to that channel surface, so that one of the armatures, for example, armature 9, will oscillate about the fulcrum of the vibration system in a plane including the cantilever and said one armature to thereby induce current in coils 5, 6, while the other armature, or armature 10, will be only subjected to rotary motion about its axis so that no change in magnetic flux is caused in the gap in which said other armature is placed with consequence that no current is induced in coils 7, 8. The other channel similarly causes a movement of the stylus tip 11 in a direction normal to this channel surface, and the result of this is that only armature 10 oscillate about the fulcrum of the vibration system in a plane including the cantilever 12 and armature 10, thereby inducing current in coils 7, 8. No current is induced in coils 5, 6. In actual operation, the movement of the stylus tip 11 is influenced by the both channels and so the motion of the armatures 9, 10 will be complex. However, because each pair of coils are only responsive to one channel component which causes a change of magnetic flux in the gap formed by their associated pole pieces, two separate signals are produced by the two pairs of coils.

In FIG. 2, which shows only one half of the transducer, namely, armature 9, pole pieces 1, 2 and coils 5, 6 corresponding to one of the channels, it will be understood that the armature 9 extends in the direction in which the stylus tip 11 is moved by said one channel, so that the armature 9 will oscillate across pole pieces 1 and 2 or in the plane of the sheet of the drawing.

FIG. 3 shows another embodiment of the transducer in which permanent magnet 16 is placed rearwardly of the armature 9, as viewed from the stylus tip 11, and there is provided a guide pole piece 17 for passing flux from the permanent magnet to the armature. The guide piece 17 is disposed within a hollow holder 14 and extends to the abatement between the holder 14 and damper 15, thereby providing an effective, low reluctance path for the flux. The permanent magnet 16 and the guide piece 17 are arranged in direct contact. As will be readily appreciated, it is preferable to mount the stylus assembly including the cantilever holder 14 detachably on the body including the electromagnetic means. At this end, the parts can be arranged so that as the holder is mounted, it fits with the permanent magnet 16 as by forming a groove in the end of the holder and the guide piece 17 is brought into contact with the permanent magnet 16.

FIG. 4 shows a further modification of the transducer which is similar to FIG. 3 in that a guide pole piece 17 is provided to pass the flux from the permanent magnet 16 to the armature 9. In this embodiment, the permanent magnet 16 is located between the coils 5 and 6, and the guide piece 17 extends towards the armature 9 placed below the magnet. This feature allows a greater amount of flux to be supplied to the armature 9, thereby enabling reproduction of sound with an improved S/N ratio to be obtained.

FIG. 5 shows a still another transducer which is similar to the embodiment shown in FIG. 2 in that permanent magnet 16 is placed forwardly of the armature 9, as viewed from the stylus tip 11, but differs from FIG. 2 by the provision of an additional permanent magnet 18 disposed between the pole pieces 1 and 2. The purpose of the permanent magnet 18 is to attract flux from the permanent magnet 16 so as to achieve a more effective passage of the flux through the armature 9, rather than directly acting to magnetize the armature 9. An improved S/N ratio can be assured by this means as in the embodiment of FIG. 4.

The stylus assembly of FIG. 6 is similar to that shown in FIG. 1, but is provided, in addition to armatures 9 and 10, with a tubular auxiliary armature 20 which is fitted around the cantilever 12 forwardly of the armature securing member 13. The auxiliary armature 20 is formed of similar high permeability material as used for the armatures 9 and 10 and is adapted to move with the oscillation of the stylus tip 11. When this stylus assembly is used in a transducer as shown in FIGS. 1, 2 and 5 in which the permanent magnet 16 is disposed forwardly of the gaps, the auxiliary armature 20 will cause an increase of magnetic flux to armatures 9 and 10. This provided for more positive separation of channel components of the vibration. In addition, the auxiliary armature 20 will assist in better guiding the flux from the permanent magnet 16 to the armatures 9, 10. Still further, the auxiliary armature 20 provides a strengthening effect upon the strength of the thin cantilever 12 to prevent flexure of the cantilever 12 which may otherwise occur as a result of the vibration thereof, thereby removing secondary resonance as well as the drooping in the medium region of frequency response.

The transducer shown in FIG. 7, which is depicted in the similar fashion as FIG. 2, has a vibration system and an electromagnetic means which are both different from those described above. The vibration system of this transducer does not have the cantilever holder previously mentioned, but terminates in an armature securing member 13 mounted at the rear end of the cantilever 12 and carrying armatures (only armature 9 being shown). Forwardly of the member 13 is provided on the cantilever 12 a support member 21 of an elastomeric material which acts as a damper, and the support member 21 is securedly received in a tubular holder 22 which is in turn secured to the cartridge body, thereby positioning the whole vibration system. In the electromagnetic means, pole pieces 2 and 4 associated with the armatures 9 and 10 run at an angle of 45° with respect to the vertical planes, but pole pieces 1 and 3 do not run parallel to their mating pole pieces 2 and 4, but run vertically. Furthermore, pole pieces 1 and 3 are bent at their lower end to extend towards the rear end of the cantilever 12. The pole pieces 2 and 4 are bent as shown, and the magnetic circuit for one half of the electromagnetic means is completed through pole piece 1, armature 9, pole piece 2 and permanent magnet 16 which is placed in contact with or close to a yoke 23. If desired, pole pieces 1 and 3 can be unified into a single piece. The resulting stracture still forms independent gaps for the two channels.

FIGS. 8 to 11 shows a still further embodiment of stereophonic pickup cartridge according to the invention which corresponds to the transducer of FIG. 5, but in which the stylus assembly is replaced by that of FIG. 6. Excepting for a stylus assembly 30 (shown in FIG. 10), all parts and components are assembled in and properly secured in position in a casing 31 of high permeability material, which also serves as a shield. The casing 31 has a pair of flanges 32 in its top for use in mounting the cartridge on a tone arm. The assembled cartridge is shown in FIGS. 8 and 9. Two pairs of terminals 33 project from the rear end of the cartridge casing 31 for connection with an amplifier which amplifies reproduced signals. In the bottom wall of the casing 31 there is formed a window 34 and in communication with the window 34 there is provided a receptacle 58 (not shown in FIG. 8 but shown in FIG. 9) into which a part of the stylus assembly 30 is inserted for attachment, the stylus assembly 30 covering substantial part of the bottom of the casing 31. FIG. 8 shows part of the stylus assembly 30, that is, a knob 35 moulded from synthetic resin, cantilever 36, stylus tip 37, auxiliary armature 38, armature securing member 39, a pair of armatures 40, 41 secured to the member 39 and only partly shown, and damper 42. The pair of armatures 40, 41 are secured to the member 39 at the rear end of the cantilever 36 so as to extend in a plane perpendicular to the cantilever 36 and with an angle of indication of 45° with respect to the vertical plane including the axis of the cantilever 36 as previously described. These armatures are positioned in independent gaps formed by two pairs of pole pieces, only one pole piece of each pair being shown in FIG. 8 at 43 and 45 as seen within the window 34 of the casing 31. Obviously opposite pole pieces are provided to define the gaps. In FIGS. 8 and 9, it will be seen that a permanent magnet 47 is arranged forwardly of the pole pieces 46, 45, as viewed from the stylus tip 37, so as to be opposite to the auxiliary armature 38. The casing 31 provides a substantially complete magnetic shield so as to preclude the flux within the gaps from being influenced by external sources, such as stray field, other than by armatures 40 and 41.

In FIG. 9, it will be noted that the cartridge casing 31 is engaged and closed at its rear part by a terminal board 48 carrying the terminals 33. Thus the board 48 is mounted in place after the transducer has been assembled within the casing 31.

The electromagnetic means of the transducer is formed as one block as shown in FIG. 1, and the one half is shown in FIG. 9 as comprising pole pieces 45, 46 connected together by a yoke 49 with coils 50, 51 being wound on opposite legs. The coils 50, 51 are connected in series so as to be additive for induced voltages. As will be understood, the ends of the pole pieces 45, 46 are arranged at right angles with respect to the ends of the other pair of pole pieces not shown. In order to facilitate the assembly of the cartridge and to assure the correct positioning of the pole pieces at all times, the pole pieces are embedded in a resin moulding 52, it being understood that a free space is left for the gaps defined between the pole pieces. The resin moulding 52 occupies a substantial space within the casing 31, and has a front end portion 53 which extends to the front wall of the casing and a rear end portion 54 which is shaped to be engaged with a groove 55 formed in the terminal board 48. Also the resin moulding 52 has a top end portion 56 which contacts the inwardly extending end 57 of the terminal board 48, when in place, and thus allows the terminal board 48 to be a sliding fit with the casing wall and portion 56. The resin moulding 52 is formed with a receptacle 48 rearwardly of the pole pieces, for reception of a part of the stylus assembly 30 to thereby assist in predeterminedly positioning the armatures 40, 41 in relation to the gaps formed by their respective pole pieces. The magnetic shield provided by the casing 31 encloses the electromagnetic means, but permits a part of the resin moulding 52 to be exposed at its window 34.

To the end facilitating the mounting of the stylus assembly 30 of FIG. 10 on the cartridge body shown in FIGS. 8 and 9, with the armatures predeterminedly positioned within the gaps of the electromagnetic means, the resin knob 35 of the stylus assembly is centrally provided with a post-shaped plug 59 which is engageable with the receptacle 58 within resin moulding 52 to hold the entire stylus assembly firmly. To prevent unintended disengagement or loosening of the plug 59 from the receptacle 58, an annular lock ring 60 of an elastomeric material is fitted in a corresponding groove in the receptacle 58 so as to project a slight distance internally from the inner wall of the receptacle. A groove 61 is formed in the periphery of the plug 59 in conformity to the projection end of the ring 60. In this manner, the stylus assembly is detachably mounted on the cartridge body. FIG. 9 best shows that the armatures are properly positioned in the gaps when plug 59 is fitted into receptacle 58, although the drawing shows this only for one of the armatures, 41. The other armature is of course similarly positioned. These armatures, therefore, will cause a change of magnetic flux in their associated gaps when vibrations are transmitted thereto through the cantilever 36 from the stylus tip 37 at the opposite end of the latter. Elastic damper 42 allows oscillatory motion of the armatures in any direction and exerts a damping effect to return them to their neutral position. Further details of the stylus assembly will be described with reference to FIGS. 10 and 11.

The permanent magnet 47 is embedded in the front end portion 53 of the resin moulding 52, but is exposed at its end face opposite to the auxiliary armature 38, through the window 34 in the casing 31. This magnet is axially magnetized and magnetizes the auxiliary armature 38 disposed below it, which in turn passes the flux to the armatures such as shown at 41. Another permanent magnet 74 is disposed between the pole pieces 45 and 46 to force the flux from the permanent magnet 47 to pass through the armature. Because of such nature of the magnet 74, the direction of magnetization thereof should be carefully determined. By experiments, it was found preferrable to magnetize the attraction magnet 74 lengthwise in the similar manner as the permanent magnet 47 when the disposition of both magnets shown in FIG. 9 is employed.

FIG. 10 and 11 show the appearance and the section of the stylus assembly shown in FIGS. 8 and 9. The knob 35 formed from synthetic resin has a bottom wall 62 and a pair of side walls 63, 64, the bottom wall 62 being formed with the plug 59 previously mentioned. The plug 59 is slightly inclined towards the front or the stylus tip 37 and is formed with the groove 61 in the front part of its periphery, for engagement with the lock ring 60 in the receptacle 58 to be detented thereby. A semi-circular raised portion 65 extends from the bottom wall 62 to the front side of the plug 59, and the securing member 39 abuts, through damper 42, against the front end face of the raised portion 65, the parts 42, 39 and 36 being aligned on an extension line from the axis of the semi-circular raised portion 65. The pair of armatures 40, 41 are secured to the armature securing member 39 so as to lie in a plane perpendicular to the axis of the cantilever 36 and to have an angle of inclination of 45° with the vertical plane including the axis of the cantilever 36. AS is apparent from FIGS. 8 and 9, the knob 35, moulded from synthetic resin, covers the bottom of the casing 31 with the bottom wall 62 thereof and externally engages the both side of the casing with the side walls 63 and 64 thereof. Therefore, the spacing between the side walls 63 and 64 depends on the dimension of the casing. It will be seen that the knob 35 is firmly assembled to the cartridge body by means of the plug 59 and side walls 63 and 64.

The cantilever 36 is formed from a nonmagnetic metal, for example, aluminium, to a tube form. A pipe of high permeability material which constitutes the auxiliary armature 38 is fitted on and secured to the tubular cantilever 36 adjacent the rear end thereof. Into the rear end of the tubular cantilever 36 is forcibly pressed a fixing pipe 66, to which a support or fulcrum wire 67 is firmly bonded. The support or fulcrum wire can be a metal wire, preferably a relatively thin piano wire. The support or fulcrum wire 67 extends a substantial distance rearwardly from the fixing pipe 66, and is surrounded by and unified with another fixing pipe 68 over its length from a point adjacent the rear end of the cantilever 36 to the other end of the wire. The securing member 39 for the armatures is mounted on the rear end of the cantilever 36, and rearwardly of the member 39 is disposed the damper 42 of an elastomeric material which is in turn followed by a mounting pipe 69 that is connected with the fixing pipe 68. The clearance left between the two fixing pipes 66 and 68 is important, because it allows the oscillatory motion of the cantilever. It is also important in establishing and maintaining the fulcrum of vibration at a fixed point. The center of the clearance is at or closely adjacent the fulcrum of vibration, and therefore the armatures 40 and 41 are positioned in a plane passing through this center and perpendicular to the axis of the cantilever 36. The armature securing member 39 is moulded, by casting a synthetic resin such as ABS resin, and thus has a reduced rigidity as compared with that of the cantilever 36 which is usually formed as tubular body of aluminium, so as to properly position the armatures 40 and 41 therein. Simultaneously, a through hole for subsequently passing the cantilever 36 can be formed when casting the member 39. The member 39 and cantilever 36 are firmly held togehter by friction at the wall of said hole.

From the foregoing, it will be appreciated that the stylus sub-assembly of the embodiment illustrated in FIGS. 8 to 11 is comprised of tubular member 36, stylus 37, auxiliary armature 38, securing member 39, armature 40, 41 carried thereby, damper 42, fixing pipes 66, 68, mounting pipe 69, which surrounds fixing pipe 68, and mounting wire 67. The stylus sub-assembly is mounted to form the stylus assembly of FIG. 10 by inserting the mounting pipe 69 into a transverse bore extending across the semi-circular raised portion 65 and the plug 59 of the knob 35. Thus the knob 35 acts as a cantilever holder. For the purpose of fixing the stylus sub-assembly to the knob 35, the plug 59 is formed with an axially extending receptacle 70 receiving a nut 71 which is threadably engaged by a clamp screw 72, thereby allowing the mounting pipe 69 of the stylus sub-assembly, which traverses across the plug 59, to be fixed in position by engagement with the clamp screw 72. If desired, by loosening the clamp screw 72, the relative position of the mounting pipe 69 to the plug 59 of the knob 35 can be adjusted. This obviously alters the distance between the rear surface of the armature securing member 39 and the front end surface of the semi-circular raised portion 65, so that the compression applied to the damper 42 and the tension in the support or fulcrum wire 67 can be freely adjusted. It will be appreciated that the stylus assembly of this embodiment is of compact and reasonable design in that it can be mounted on the cartridge body (as shown in FIG. 9) by merely holding it at the side walls 63 and 64 of the knob 35, thus without touching the stylus tip 37 and the armatures 40, 41.

FIG. 12 shows a modified form of a stylus sub-assembly in section. The sub-assembly is constituted in part as an integral moulding comprising an armature securing member 39, support or fulcrum wire 67 and a mounting member 69, these parts serving the same purpose as the like numbered parts of the FIG. 11 embodiment previously described. The integral moulding may be produced by casting synthetic resin by techniques known per se. Thus a suitable metal mould of separate parts shaped to provide the moulded sections of the structure of FIG. 12 may be used for mass production of stylus sub-assemblies of uniform characteristics and at rotably reduced cost. The armatures 40, 41 of high permeability or a permanent magnet material and the cantilever arm 36 of a non-magnetic metal, preferably tubular aluminum, which complete the stylus sub-assembly, are fixed to the securing member 39 by at least partially embedding these parts in the resin material during the moulding operation. Where it is desired to strengthen the junction between the securing member and the cantilever arm 36, the member 39 may be formed with a projection 73 which extends into the cantilever arm 36 during its partial embedment in the cantilever arm 36. The armatures 40 and 41 are arranged at the predetermined position when the left end surface of the mounting member 69 in FIG. 12 conforms to the surface of the semi-circular raised portion 65 so as to form an identified plane there between.

As a variant, the cantilever arm 36 need not be embedded in the securing member as shown in FIG. 12 but need only be fitted to the projection 73 for securement thereby subsequent to the moulding operation.

As previously mentioned, the armatures 40, 41 may be of high permeability or ferromagnetic material. It is to be understood that when the armatures are of high permeability material, permanent magnets will be used in the assembled cartridge which may be related to the armatures 40, 41 as shown in FIGS. 1, 2, 4 or 5. If an auxiliary armature 38 is used in the FIG. 12 embodiment and related to the cantilever arm 36 as in the FIG. 11 embodiment, then the cartridge may include permanent magnets 47 and 74 related to the cantilever arm 36 and the auxiliary armature 38 as shown in the FIG. 11 embodiment.

Where the armatures 40, 41 are of permanent magnet material, additional magnets such as magnets 16 of FIGS. 1 to 5 and 7 or permanent magnet 18 of FIG. 5 and 47 and 74 of FIG. 9 are not required.

It will be understood that the stylus sub-assembly of FIG. 12 is mounted to the knob 35 by introducing the mounting member into the transverse opening in the post-shaped member 59 and secured in place by clamp screw 72 in a manner similar to that described in relation to the FIG. 11 embodiment.

A damper similar to damper 42 may be associated with the stylus sub-assembly of FIG. 12. The damper is effectively positioned between the facing walls of the mounting member 69 and the armature securing member 39, preferably in contact with the adjacent wall of the mounting member 39 and with the semi-circular raised portion 65 which extends from the bottom wall 62 of knob 35. For positioning, the damper of butyl rubber is provided with a hole or pinhole at its central portion and is mounted in position by expanding the pinhole from the right end of the mounting member 69 in FIG. 12.

As will be seen in FIG. 12, the fulcrum wire 67 of the integral moulding has a cross section substantially smaller than that of the mounting and armature securing members. Also the mounting wire is connected to the facing walls of said members at substantially central regions thereof.

As described above, in accordance with the invention, the armatures is attached, not directly to the cantilever arm, but to the armature securing member having a reduced rigidity as compared with the cantilever arm, and the stiffness of the armature securing member serves suppressing a peak in the resonance frequency and mechanical impedance in the high frequency range. Because such suppression is achieved without resert to damping resistance presented by an elastic damper, a flat response is accomplished with a substantially reduced resonance frequency in the high frequency range and without increasing the mechanical impedance in the mid-range frequencies.

What is claimed is:

1. In a stylus assembly for incorporation in a cartridge destined for mounting on a tone arm of a record player, a stylus sub-assembly comprising an elongate integral synthetic resin moulded composite structure having a longitudinal axis and being constituted of (a) a mounting member, (b) an armature securing member axially spaced from said mounting member and (c) an interconnecting section between adjacent facing ends of said mounting and armature securing members and connect thereto at substantially central regions thereof, said interconnecting section serving as a fulcrum wire having a transverse section substantially smaller than each of the transverse sections of said mounting and armature securing members, an elongate cantilever arm adapted to have a stylus at one end thereof and being fixed at its opposite end to said armature securing member at a side thereof opposite that to which the fulcrum wire is connected, and a pair of armatures secured to said armature securing member and being disposed on opposite sides of a vertical plane including the longitudinal axis of said cantilever arm, said armatures beig disposed at an angle of inclination of 45° relative to said axis and being disposed at right angles to each other, said mounting member, armature securing member and intermediate interconnecting fulcrum wire comprising a single unitary component.

2. An assembly according to claim 1, including a damper of elastic material, said damper being formed with an opening and being interposed between said mounting member and said armature securing member, said fulcrum wire of said synthetic resin composite structure extending between said mounting member and said armature securing member within said opening.

3. An assembly according to claim 1, wherein said armatures are of high permeability material and are secured at one of their ends in said securing member by embedment in the resin thereof, the opposite ends of high permeability material being freely exposed and adapted for positioning in gap of respective pole pieces for said armatures.

4. An assembly according to claim 1, wherein the cantilever arm is hollow, a projection being formed on said armature securing member solely on said side thereof opposite that to which said fulcrum wire is connected, said hollow cantilever arm telescopically fitting over said projection.

5. An assembly according to claim 1, wherein the fulcrum wire has a fulcrum point disposed rearwardly, related to the stylus end of the cantilever arm, of said armatures.

6. A stylus assembly for a stereophonic pick-up cartridge comprising an elongated axially extending cantilever arm having a stylus tip at one end thereof, an armature securing member fixed to said cantilever arm at the other end thereof, said armature securing member consisting of a non-magnetic material having a rigidity less than that of the cantilever arm, discrete first and second, spaced apart armatures, each adapted to be associated with a separate magnetic circuit and to this end each said first and second armatures being secured to said armature securing member on opposite sides of a vertical plane including the axis of the cantilever arm and being disposed at an angle of inclination of 45° relative to said vertical plane at right angles to each other, support means spaced from said armature securing member on that side thereof most distant from said stylus tip for supporting the cantilever arm together with the armature securing member at a single fulcrum, and a damper of elastic material interposed in the space between said support means and said armature securing member and in engagement with each for damping vibratory movement of said armature, said support means, said damper and said armature securing member being aligned along the axis of said cantilever arm.

7. A stylus assembly according to claim 6 in which the armature securing member is moulded from synthetic resin.

8. A stylus assembly according to claim 7, wherein said armatures consist of rod-shaped members, each having a width substantially smaller than its length.

9. A stylus assembly according to claim 6, wherein said first and second armatures consist of rod-shaped members, each having a width substantially smaller than its length.

10. A stylus assembly according to claim 6, wherein said support means comprises at least one fixing pipe and a mounting pipe which surrounds the fixing pipe, said pipes extending rearward of said armature securing member in axial alignment with said cantilever arm and having an axial extent substantially greater than their transverse dimension.

11. A stylus assembly according to claim 6, wherein said armature securing member has a central passage passing therethrough in axial alignment with said cantilever arm and wherein said support means is of non-magnetic material and has a base portion and an element upstanding therefrom for reception in a receptacle of the pick-up cartridge, said upstanding element having a bore extending therethrough in axial alignment with said passage in said armature securing member, said damper being formed with a passage in axial alignment with said bore of said upstanding element and with said central passage in said armature securing member, said support means including a fulcrum wire secured at one of its ends to the other end of said cantilever arm and passing freely through said central passage in said armature securing member but fixed in its extension through the damper passage and said bore in said upstanding element.

12. A stylus assembly for a stereophonic pick-up cartridge having an enclosure formed with an opening in its bottom and support means for said stylus assembly and being of non-magnetic material having a base portion and an upstanding portion extending upwardly from the base portion through said opening for securement within said enclosure, comprising a cantilever arm having a stylus tip at one end thereof, an armature securing member fixed to said cantilever arm at the other end thereof, said armature securing member consisting of a non-magnetic material having a rigidity less than that of said cantilever arm, discrete first and second, spaced apart, armatures each adapted to be associated with separate magnetic circuits and to that end each said first and second armatures being secured to said armature securing member on opposite sides of a vertical plane including the axis of said cantilever, said armatures being disposed at an angle of inclination of 45° relative to said vertical plane and being disposed at right angles to each other, a resin molding within said enclosure and formed with a receptacle for receiving said upstanding portion of said support means for detachably securing said upstanding portion within said receptacle in said resin molding and thereby said support means to said resin molding, said base portion, with the support means thus secured, covering said opening in said enclosure, said upstanding portion of the support means being formed with a bore which extends through the central portion thereof in a direction inclined with respect to the bottom of said enclosure, a mounting member located in said bore, fulcrum means having one of its ends secured to the other end of said cantilever arm and its other end extending through and secured to said mounting member, and a damper of an elastic material placed between the armature securing member and said upstanding portion, said fulcrum means extending through said damper and being tensioned so as to maintain said damper in abutting relationship with said upstanding portion of the support means and the other end of said cantilever.

13. A stylus assembly according to claim 12, wherein said receptacle within said resin molding is defined by a cylindrical wall formed with a groove therein, said securing means comprising an annular lock ring fitted within the groove of said cylindrical wall and having an inner diameter portion extending outwardly of said groove for reception in an annular groove formed in said upstanding portion of said support means.

* * * * *